US011189222B1

(12) United States Patent
Aogaki et al.

(10) Patent No.: US 11,189,222 B1
(45) Date of Patent: Nov. 30, 2021

(54) DEVICE AND METHOD FOR MURA COMPENSATION

(71) Applicant: Synaptics Incorporated, San Jose, CA (US)

(72) Inventors: Kazutoshi Aogaki, Kanagawa (JP); Hirobumi Furihata, Tokyo (JP); Takashi Nose, Kanagawa (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/951,715

(22) Filed: Nov. 18, 2020

(51) Int. Cl.
*G09G 3/3208* (2016.01)
*G09G 3/00* (2006.01)

(52) U.S. Cl.
CPC ..... *G09G 3/3208* (2013.01); *G09G 3/006* (2013.01); *G09G 2320/0233* (2013.01); *G09G 2320/0276* (2013.01); *G09G 2360/147* (2013.01)

(58) Field of Classification Search
CPC ..... G09G 3/3208; G09G 2320/0276; G09G 3/006; G09G 2360/147; G09G 2320/0233
See application file for complete search history.

(56) References Cited

U.S. PATENT DOCUMENTS

2018/0158434 A1* 6/2018 Bian ..... G09G 5/10
2018/0166003 A1* 6/2018 Wang ..... G06T 5/003
2018/0166030 A1* 6/2018 Liu ..... G09G 3/20
2019/0378474 A1* 12/2019 Kuo ..... G09G 5/10
2021/0065633 A1* 3/2021 Li ..... G09G 3/3225

* cited by examiner

*Primary Examiner* — Muhammad N Edun
(74) *Attorney, Agent, or Firm* — Ferguson Braswell Fraser Kubasta PC

(57) ABSTRACT

A display driver includes image processing circuitry and driver circuitry. The image processing circuitry is configured to process image data for a plurality of pixel circuits of a display panel. The image processing circuitry includes a demura table comprising one or more base compensation values associated with each of the plurality of pixel circuits, and a lookup table (LUT) comprising one or more compensation coefficients associated with each of a plurality of frame rates. Processing the image data for the pixel circuits comprises a mura compensation for at least one pixel circuit of the plurality of pixel circuits using the one or more base compensation values and the one or more compensation coefficients. The drive circuitry is configured to update the plurality of pixel circuits based on the processed image data.

20 Claims, 9 Drawing Sheets

FIG. 9

| | | First Frame Rate (e.g., 60Hz) | | | | | | Second Frame Rate (e.g., 90Hz) | | | | | | Third Frame Rate (e.g., 120Hz) | | | | |
|---|---|---|---|---|---|---|---|---|---|---|---|---|---|---|---|---|---|---|
| Graylevel | | $L_1$ | $L_2$ | $L_3$ | $L_4$ | $L_5$ | | $L_1$ | $L_2$ | $L_3$ | $L_4$ | $L_5$ | | $L_1$ | $L_2$ | $L_3$ | $L_4$ | $L_5$ |
| Pixel Circuit | $p_1$ | 2 | 8 | 10 | 12 | 18 | … | | | | | | | | | | | |
| | $p_2$ | 8 | 3 | -3 | -6 | -9 | | | | | | | | | | | | |
| | $p_3$ | 9 | 2 | 1 | 7 | 3 | | | | | | | | | | | | |
| | $p_4$ | 2 | -2 | 4 | 3 | 2 | | | | | | | | | | | | |
| | $p_5$ | 3 | 3 | 0 | 3 | 9 | | | | | | | | | | | | |
| | ⋮ | | | | | | ⋱ | | | | | | | | | | | |
| | $p_N$ | 10 | 2 | 9 | 5 | 8 | | | | | | | | | | | | |

DEVICE AND METHOD FOR MURA COMPENSATION

FIELD

The disclosed technology generally relates to a device and method for mura compensation for a display device.

BACKGROUND

A display panel may experience variations in the characteristics of pixel circuits. The variations may cause mura defects on the display panel. Mura defects may impact the quality of an image displayed on the display panel.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes image processing circuitry and driver circuitry. The image processing circuitry is configured to process image data for a plurality of pixel circuits of a display panel. The image processing circuitry includes a demura table comprising one or more base compensation values associated with each of the plurality of pixel circuits, and a lookup table (LUT) comprising one or more compensation coefficients associated with each of a plurality of frame rates. Processing the image data for the pixel circuits comprises a mura compensation for at least one pixel circuit of the plurality of pixel circuits using the one or more base compensation values and the one or more compensation coefficients. The driver circuitry is configured to update the plurality of pixel circuits based on the processed image data.

In one or more embodiments, a calibration device is provided. The calibration device includes an imaging device and a processor. The imaging device is configured to acquire luminances of pixel circuits of a display panel for a plurality of frame rates. The processor is configured to generate, based on the luminances of pixel circuits for the plurality of frame rates, a demura table comprising one or more base compensation values defined for each of the pixel circuits and a LUT comprising first one or more compensation coefficients defined for each of the plurality of frame rates. The processor is configured to provide the demura table and the LUT to a display module comprising the display panel.

In one or more embodiments, a method for driving a display panel is provided. The method includes processing image data for pixel circuits of a display panel. Processing the image data for the pixel circuits comprises a mura compensation for at least one pixel circuit of the plurality of pixel circuits using one or more base compensation values from a demura table and one or more compensation coefficients from an LUT, the one or more base compensation values defined for each of the pixel circuits, and the one or more compensation coefficients defined for each of a plurality of frame rates. The method further includes updating the pixel circuits based on the processed image data.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

FIG. 9 illustrates example compensation amounts determined for respective pixel circuits in a display panel, according to one or more embodiments.

Figure 1:
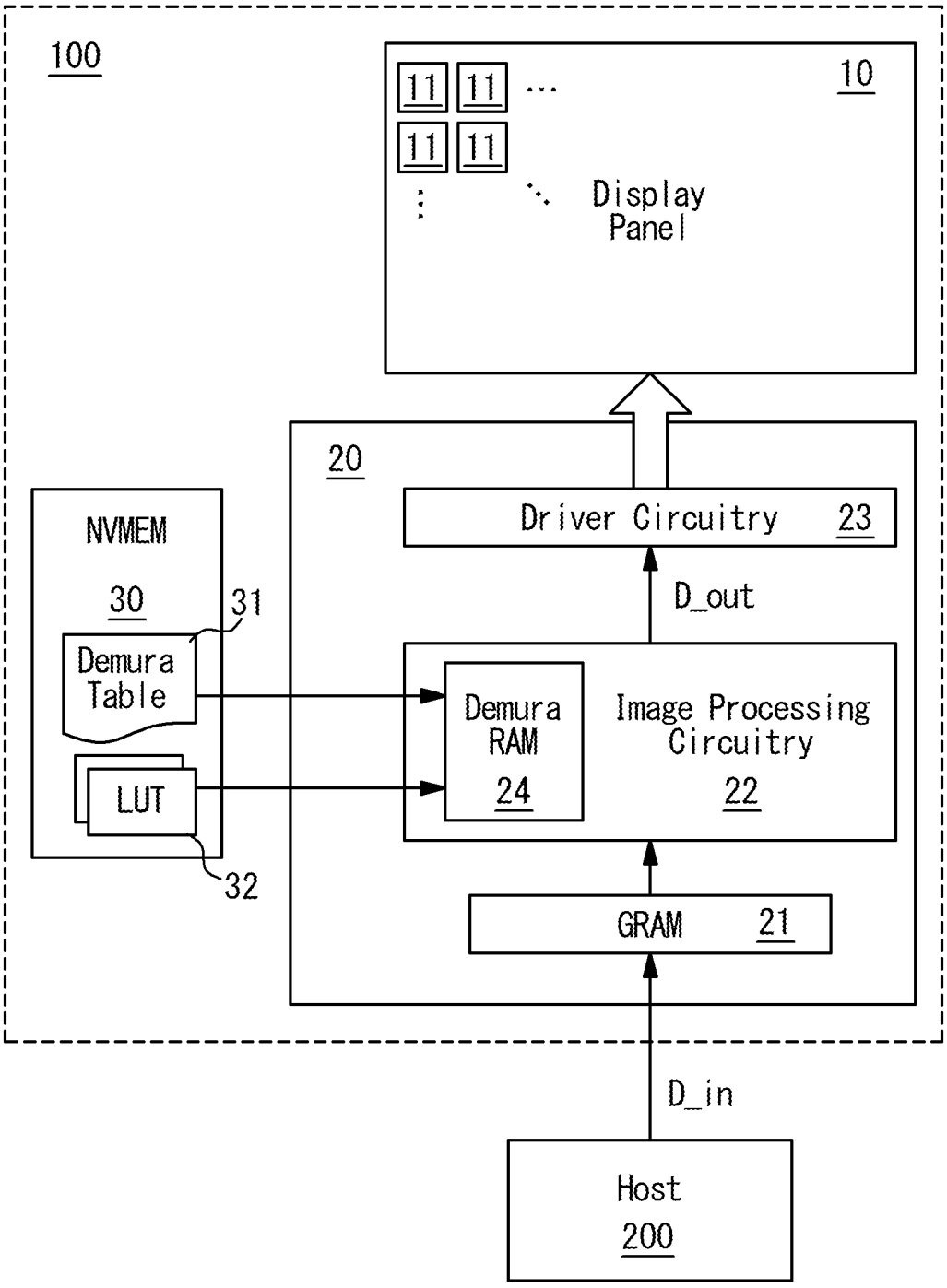
FIG. 1 illustrates an example configuration of a display module, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. Suffixes may be attached to reference numerals for distinguishing identical elements from each other. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

Mura compensation or demura is a technology to mitigate display mura (or display unevenness) caused by variations in the characteristics of pixel circuits of a display panel. Examples of the variations include variations in the characteristics of thin film transistors (e.g., threshold voltages and/or channel mobilities of the thin transistors) and variations in the characteristics of light emitting elements (e.g., organic light emitting diodes (OLED) and micro light emitting diode (LED)). In various implementations, mura compensation is achieved through digital processing in a display driver based on demura data generated from information of characteristics variations in the pixel circuits. The demura data may be prepared for each pixel circuit and used to determine the compensation amount for the corresponding pixel circuit. In one implementation, display mura is measured for the display panel during a test or calibration process, and the demura data is prepared for each pixel circuit based on the measured display mura. The demura data may be stored in the display driver or in an external storage device connected to the display driver.

Display mura may depend on the frame rate, and therefore mura compensation adaptive to changes in the frame rate may improve the image quality. One approach to achieve this is to prepare demura data for each allowed frame rate. Such approach may however increase the size of the demura data, which are prepared for the respective pixel circuits of the display panel, causing an increase in the hardware used to store the demura data.

The present disclosure provides a technology to achieve a mura compensation adapted to changes in the frame rate with reduced hardware. In one or more embodiments, the mura compensation is achieved using a demura table comprising one or more base compensation values associated with each of the plurality of pixel circuits, and a lookup table (LUT) comprising one or more compensation coefficients associated with each of a plurality of frame rates. In this scheme, the lookup table may store information concerning the frame rate dependency of the display mura, eliminating the need of preparing a demura table for each allowed frame rate. The use of the lookup table may provide a mura compensation adapted to changes in the frame rate with reduced hardware.

FIG. 1 illustrates an example detailed configuration of a display module 100, according to one or more embodiments. In the illustrated embodiment, the display module 100 is configured to display an image corresponding to input image data D_in received from a host 200. Examples of the host 200 may include an application processor, a central processing unit (CPU), or other processors. The display module 100 includes a display panel 10, a display driver 20, and a non-volatile memory 30. Examples of the display panel 10 include an organic light emitting diode (OLED) display panel, a micro light emitting diode (LED) display panel, and other self-luminous display panels. Examples of the non-volatile memory 30 may include a flash memory, an electrically erasable programmable read-only memory (EEPROM), a magnetic random-access memory (MRAM) and other types of non-volatile memories.

The display panel 10 includes pixel circuits 11 each configured to display a desired color (e.g., red, green, or blue). In some embodiments, each pixel circuit 11 may include one or more thin film transistors (TFTs) and/or a light emitting element (e.g., an OLED and an LED). The characteristics of the pixel circuits 11 may vary for example due to manufacturing variations, which may cause display mura on the display panel 10.

The display driver 20 is configured to update the pixel circuits 11 of the display panel 10 based on the input image data D_in received from the host 200. In various implementations, the input image data D_in includes graylevels specified for the respective pixel circuits 11. In such implementations, the pixel circuits 11 may be updated based on the corresponding graylevels. In the illustrated embodiment, the display driver 20 includes a graphic random-access memory (GRAM) 21, image processing circuitry 22, and driver circuitry 23.

The GRAM 21 is configured to temporarily store the input image data D_in received from the host 200 and forward the input image data D_in to the image processing circuitry 22. In other embodiments, the GRAM 21 may be omitted and the input image data D_in may be directly transferred to the image processing circuitry 22.

The image processing circuitry 22 is configured to process the input image data D_in received from the GRAM 21 to generate output voltage data D_out. The output voltage data D_out may include voltage values that specify voltage levels of output voltages with which the respective pixel circuits 11 of the display panel 10 are to be updated or programmed. The processing performed by the image processing circuitry 22 includes a mura compensation. Details of the mura compensation will be described later.

The driver circuitry 23 is configured to generate output voltages to be provided to the respective pixel circuits 11 of the display panel 10 based on the output voltage data D_out received from the image processing circuitry 22. In one implementation, the driver circuitry 23 is configured to update the respective pixel circuits 11 with the voltage levels specified by the corresponding output voltage data D_out.

In one implementation, the image processing circuitry 22 includes a demura random access memory (RAM) 24 configured to store data used for the mura compensation. In one implementation, the data stored in the demura RAM 24 includes a demura table 31 and one or more LUTs 32, both received from the non-volatile memory 30. The term table refers to any data structure that relates sets of values. The demura table 31 includes information concerning characteristics variations in the pixel circuits 11 of the display panel 10. In one or more embodiments, the demura table 31 may include one or more base compensation values defined for each of the pixel circuits 11 in one or more embodiments. The one or more LUTs 32 include information concerning the frame rate dependency of the display mura. In one or more embodiments, the one or more LUTs 32 include one or more compensation coefficients defined for each of a plurality of frame rates.

Figure 2:
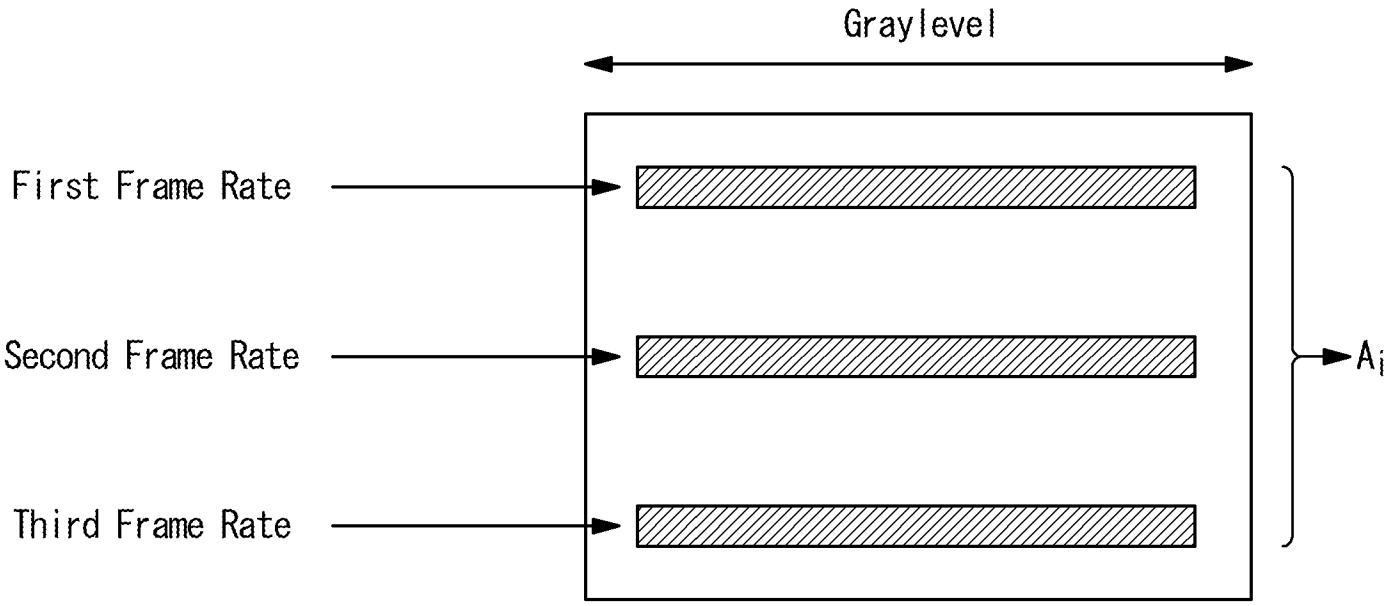
FIG. 2 illustrates example contents of a lookup table (LUT) used for mura compensation, according to one or more embodiments.

FIG. 2 illustrates example contents of an LUT 32. In one or more embodiments, the LUT 32 includes a plurality of sets of compensation coefficients defined for a plurality of frame rates, respectively. In the illustrated embodiment, the LUT 32 include three sets of compensation coefficients defined for first, second, and third frame rates, respectively. In one example, the first, second, and third frame rates may be 60 Hz, 90 Hz, and 120 Hz, respectively. Each set of the compensation coefficients are commonly used for a mura compensation for the pixel circuits 11 in the display panel 10. In one implementation, the one or more compensation coefficients defined for each of the first, second, and third frame rates are commonly used for a mura compensation for different pixel circuits 11. Each set of compensation coefficients defined for the corresponding frame rate may include a plurality of compensation coefficients defined for a plurality of graylevels, respectively. In such embodiments, the LUT 32 further include information concerning the graylevel dependency of the display mura. The LUT 32 is used to determine a compensation coefficient $A_i$ for a specified graylevel and frame rate.

Referring back to FIG. 1, the non-volatile memory 30 is configured to store the demura table 31 and the one or more LUTs 32 in a non-volatile manner and supply the same to the demura RAM 24. The demura table 31 and the one or more LUTs 32 may be transferred from the non-volatile memory 30 to the demura RAM 24 at a startup or reset of the display module 100.

Figure 3:
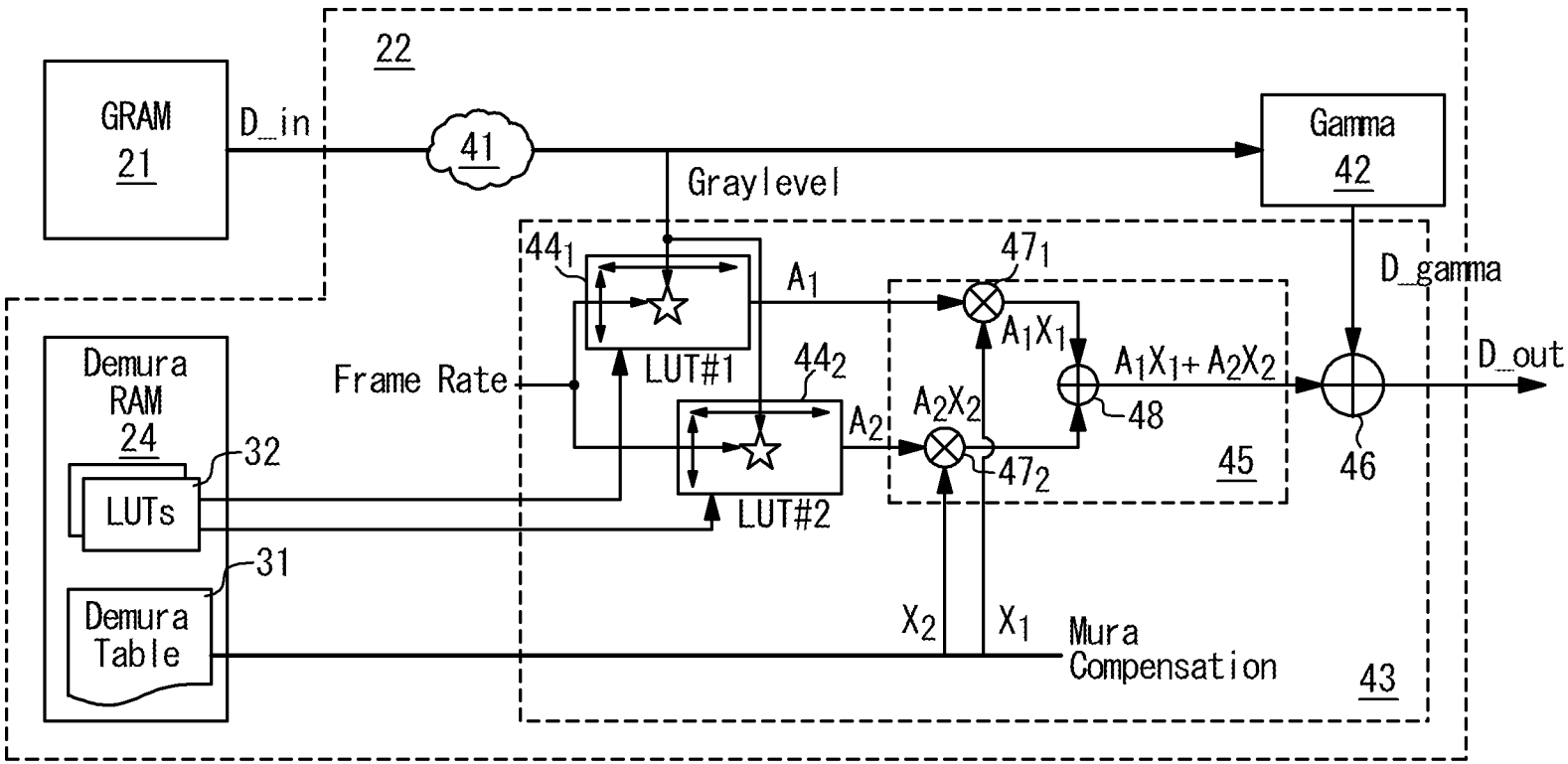
FIG. 3 illustrates an example configuration of image processing circuitry, according to one or more embodiments.

FIG. 3 illustrates an example configuration of the image processing circuitry 22, according to one or more embodiments. The image processing circuitry 22 is configured to perform a gamma transformation, a mura compensation, and optionally other image processing. In the illustrated embodiments, the image processing circuitry 22 includes an image processing component 41, gamma circuitry 42, and mura compensation circuitry 43. In some embodiments, the image processing component 41 is configured to apply desired image processing (e.g., color adjustment, scaling, and sub-pixel rendering) to the input image data D_in to generate processed image data. In other embodiments, the image processing component 41 may be omitted, and the input image data D_in is provided to the gamma circuitry 42 without modification.

The gamma circuitry 42 is configured to apply a gamma transformation to the processed image data received from the image processing component 41 (or the input image data D_in received from the GRAM 21) to generate gamma-transformed data D_gamma. The gamma transformation may convert the graylevels contained in the processed image data (or the input image data D_in) to voltage values that specify the voltage levels of the output voltages with which the pixel circuits 11 of the display panel 10 are to be updated or programmed. In such embodiments, the gamma-transformed data D_gamma includes the voltage values generated through this conversion.

The mura compensation circuitry 43 is configured to apply a mura compensation to the gamma-transformed data D_gamma to generate the output voltage data D_out. The mura compensation is based on the demura table 31, and the one or more LUTs 32 stored in the demura RAM 24. In one or more embodiments, the mura compensation for a pixel circuit 11 of interest is based on one or more base compensation values defined for the pixel circuit 11 in the demura table 31, and one or more compensation coefficients defined for the frame rate specified for the current frame period. In one implementation, the frame rate of the current frame period may be specified by the host 200 or timing controller integrated in the display driver 20. In the illustrated embodiment, the mura compensation for the pixel circuit 11 of interest is based on two base compensation values $X_1$ and $X_2$ acquired from the demura table 31 for the pixel circuit 11 and two compensation coefficients $A_1$ and $A_2$ acquired from two LUTs 32 for the frame rate specified for the current frame period. In other embodiments, the number of the base compensation values and the compensation coefficients used to the mura compensation for each pixel circuit 11 may be one, or three or more.

In the illustrated embodiments, the mura compensation circuitry 43 includes table lookup circuits $\mathbf{44}_1$ and $\mathbf{44}_2$, a compensation amount determination circuit 45, and a compensation processing circuit 46. The table lookup circuit $\mathbf{44}_1$ is configured to determine the compensation coefficient $A_1$ based on the frame rate specified for the current frame period and the graylevel specified by the processed image data (or the input image data D_in) for the pixel circuit 11 of interest through a table lookup on one of the LUTs 32 (referred to as LUT #1, hereinafter). In some embodiments, the table lookup circuit $\mathbf{44}_1$ is configured to determine the compensation coefficient $A_1$ as the compensation coefficient correlated in LUT #1 with the frame rate specified for the current frame period and the graylevel specified by the processed image data for the pixel circuit 11 of interest. For example, the table lookup circuit $\mathbf{44}_1$ may be configured to, when the frame rate specified for the current frame period is the first frame rate (e.g., 60 Hz), select the compensation coefficient $A_1$ as a corresponding one of the compensation coefficients defined for the first frame rate, the corresponding one being correlated with the graylevel specified by the processed image data for the pixel circuit 11 of interest (also see FIG. 2). In embodiments where LUT #1 does not define the graylevel specified by the processed image data, the table lookup circuit $\mathbf{44}_1$ may be configured to select two of the set of the compensation coefficients defined in LUT #1 for the frame rate specified for the current frame period and determine the compensation coefficient $A_1$ through interpolation of the two selected compensation coefficients.

The table lookup circuit $\mathbf{44}_2$ is configured to determine the compensation coefficient $A_2$ based on a different one of the LUTs 32 (referred to as LUT #2, hereinafter) in a similar manner. The table lookup circuit $\mathbf{44}_2$ is configured to determine the compensation coefficient $A_2$ based on the frame rate specified for the current frame period and the graylevel specified by the processed image data (or the input image data D_in) for the pixel circuit 11 of interest through a table lookup on LUT #2. In some embodiments, the table lookup circuit $\mathbf{44}_2$ is configured to determine the compensation coefficient $A_2$ as the compensation coefficient correlated in LUT #2 with the frame rate specified for the current frame period and the graylevel specified by the processed image data for the pixel circuit 11 of interest. In embodiments where LUT #2 does not define the graylevel specified by the processed image data, the table lookup circuit $\mathbf{44}_2$ may be configured to select two of the set of compensation coefficients defined in LUT #2 for the frame rate specified for the current frame period and determine the compensation coefficient $A_2$ through interpolation of the two selected compensation coefficients.

The compensation amount determination circuit 45 is configured to determine a compensation amount for each pixel circuit 11 based on the base compensation values received from the demura table 31 and the compensation coefficients received from the table lookup circuits $\mathbf{44}_1$ and $\mathbf{44}_2$. The compensation amount determination circuit 45 may be configured as a multiply-add circuit that calculates the compensation amount as the sum of the products of the compensation coefficients and the corresponding base compensation values of the compensation coefficients. In the illustrated embodiments, the compensation amount determination circuit 45 is configured as a multiply-add circuit that includes multipliers $\mathbf{47}_1$, $\mathbf{47}_2$, and an adder 48. The multiplier $\mathbf{47}_1$ is configured to calculate the product of the compensation coefficient $A_1$ and the base compensation value $X_1$, and the multiplier $\mathbf{47}_2$ is configured to calculate the product of the compensation coefficient $A_2$ and the base compensation value $X_2$. The adder 48 is configured to add the outputs of the multipliers $\mathbf{47}_1$ and $\mathbf{47}_2$. The compensation amount determination circuit 45 thus constructed is configured to determine the compensation amount as $A_1+A_2X_2$.

The compensation processing circuit 46 is configured to modify the gamma-transformed data D_gamma based on the compensation amounts received from the compensation amount determination circuit 45 to generate the output voltage data D_out. In one implementation, the compensation processing circuit 46 is configured as an adder that generates the voltage value of the output voltage data D_out for the pixel circuit 11 of interest by adding the compensation amount determined for the pixel circuit 11 to the voltage value of the gamma-transformed data D_gamma for the pixel circuit 11.

In the embodiment illustrated in FIG. 2, the mura compensation circuitry 43 is configured to use the demura table 31 to achieve the mura compensation for multiple frame rates, while adjusting the compensation amount based on the one or more LUTs 32 in response to the frame rate. This enables performing the mura compensation adaptive to the frame rate with reduced hardware.

In various embodiments, the frame rate of the current frame period may be allowed to be specified as a frame rate different from the frame rates correlated to the compensation coefficients in the one or more LUTs 32. For example, in embodiments where the first, second and third frame rates are correlated to the compensation coefficients in each of the LUTs 32 as illustrated in FIG. 2, the frame rate of the current frame period may be specified as a frame rate different from the first, second, and third frame rates. In such embodiments, the mura compensation circuitry 43 may be configured to determine each compensation coefficient $A_i$ for a pixel circuit 11 of interest through interpolation of two compensation coefficients that are correlated with the nearest two of the frame rates correlated in the corresponding LUT 32 and the graylevel specified for the pixel circuit 11.

Figure 4:
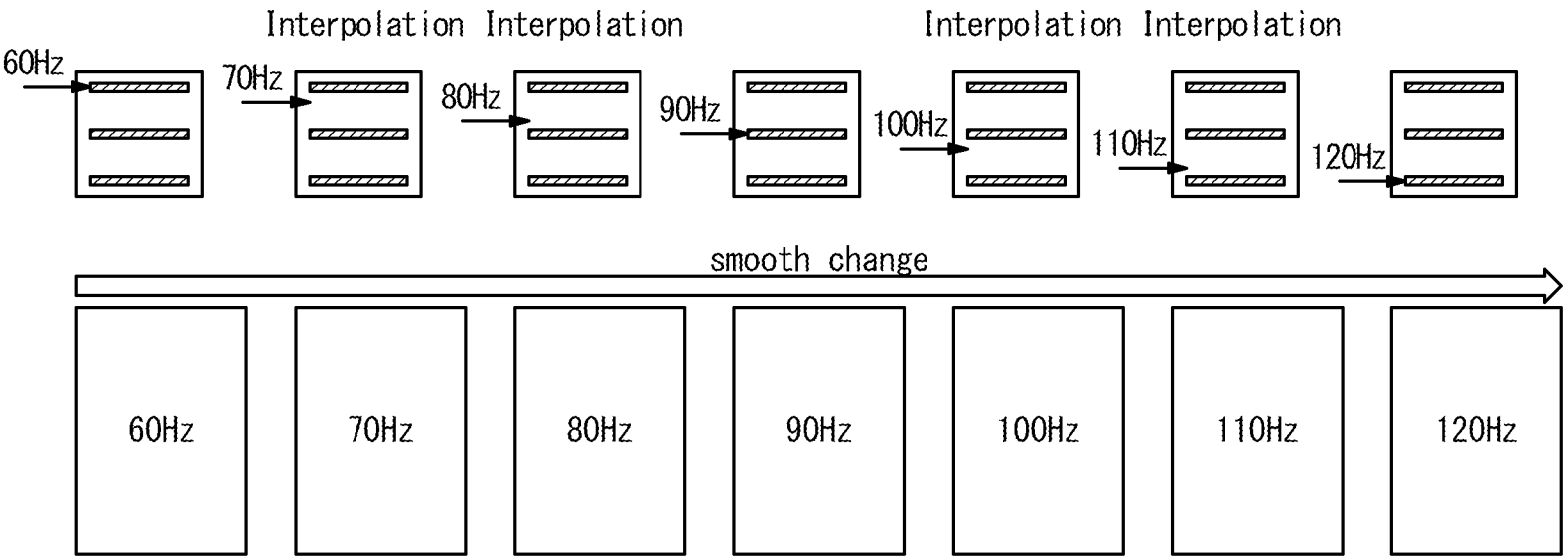
FIG. 4 illustrates an example process to determining a compensation coefficient.

FIG. 4 illustrates an example process of determining the compensation coefficient $A_i$ (e.g., $A_1$ and $A_2$ in FIG. 3) based on the corresponding LUT 32 when the specified frame rate gradually varies, according to one or more embodiments. In the illustrated embodiment, frame rates of 60, 90, and 120 Hz are correlated with compensation coefficients in the corresponding LUT 32, while the specified frame rate gradually varies from 60 Hz to 120 Hz.

In response to the frame rate being specified as 60 Hz, the mura compensation circuitry 43 determines the compensation coefficient $A_i$ as the compensation coefficient correlated with the frame rate of 60 Hz and the graylevel specified for the pixel circuit 11 of interest. When the frame rate is specified as 70 or 80 Hz, the mura compensation circuitry 43 determines the compensation coefficient $A_i$ through interpolation of the two compensation coefficients correlated with the frame rates of 60 Hz and 90 Hz and the graylevel specified for the pixel circuit 11 of interest. When the frame rate is specified as 90 Hz, the mura compensation circuitry 43 determines the compensation coefficient $A_i$ as the compensation coefficient correlated with the frame rate of 90 Hz and the graylevel specified for the pixel circuit 11 of interest. A similar goes for the frame rates of 100 to 120 Hz. This operation allows smoothly changing the compensation coefficient $A_i$ used for the mura compensation in response to the changes in the frame rate, suppressing or avoiding abrupt changes in the displayed image.

Figure 5:
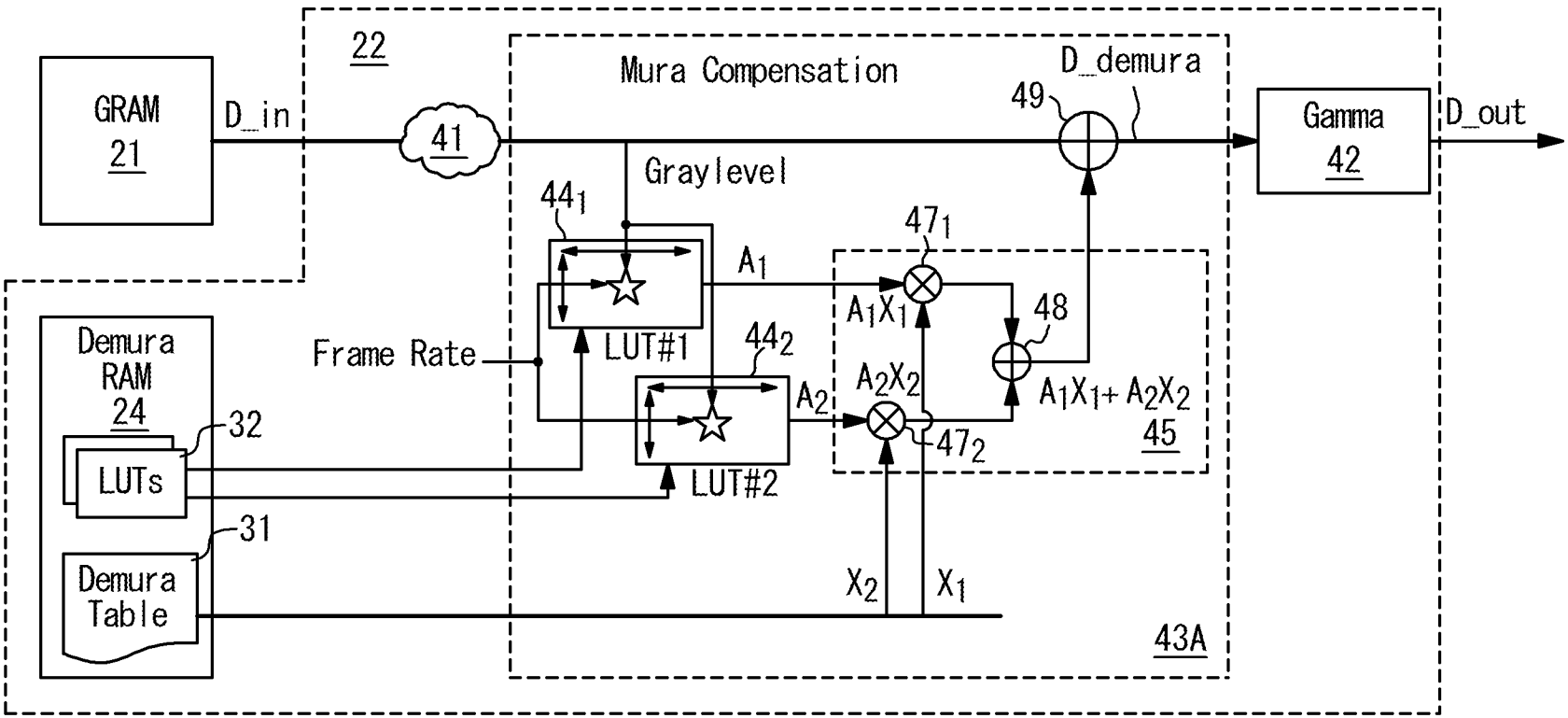
FIG. 5 illustrates an example configuration of image processing circuitry, according to other embodiments.

FIG. 5 illustrates an example configuration of the image processing circuitry 22, according to other embodiments. In the illustrated embodiment, mura compensation circuitry 43A is configured to apply a mura compensation to the processed image data received from the image processing component 41 (or the input image data D_in in embodiments where the image processing component 41 is omitted) to generate mura-compensated image data D_demura. The mura-compensated image data D_demura may include graylevels for the respective pixel circuits 11 which are acquired by modifying the graylevels of the processed image data. The gamma circuitry 42 is configured to apply a gamma transformation to the mura-compensated image data D_demura to generate the output voltage data D_out.

In the illustrated embodiment, the mura compensation circuitry 43A is configured similarly to the mura compensation circuitry 43 illustrated in FIG. 3, except for that the mura compensation circuitry 43A includes a compensation processing circuit 49 configured to modify the processed image data received from the image processing component 41 to generate the mura-compensated image data D_demura. In one implementation, the compensation processing circuit 49 is configured as an adder that generates the graylevel of the mura-compensated image data D_demura for the pixel circuit 11 of interest by adding the compensation amount determined for the pixel circuit 11 to the graylevel of the processed image data received from the image processing component 41.

Figure 6:
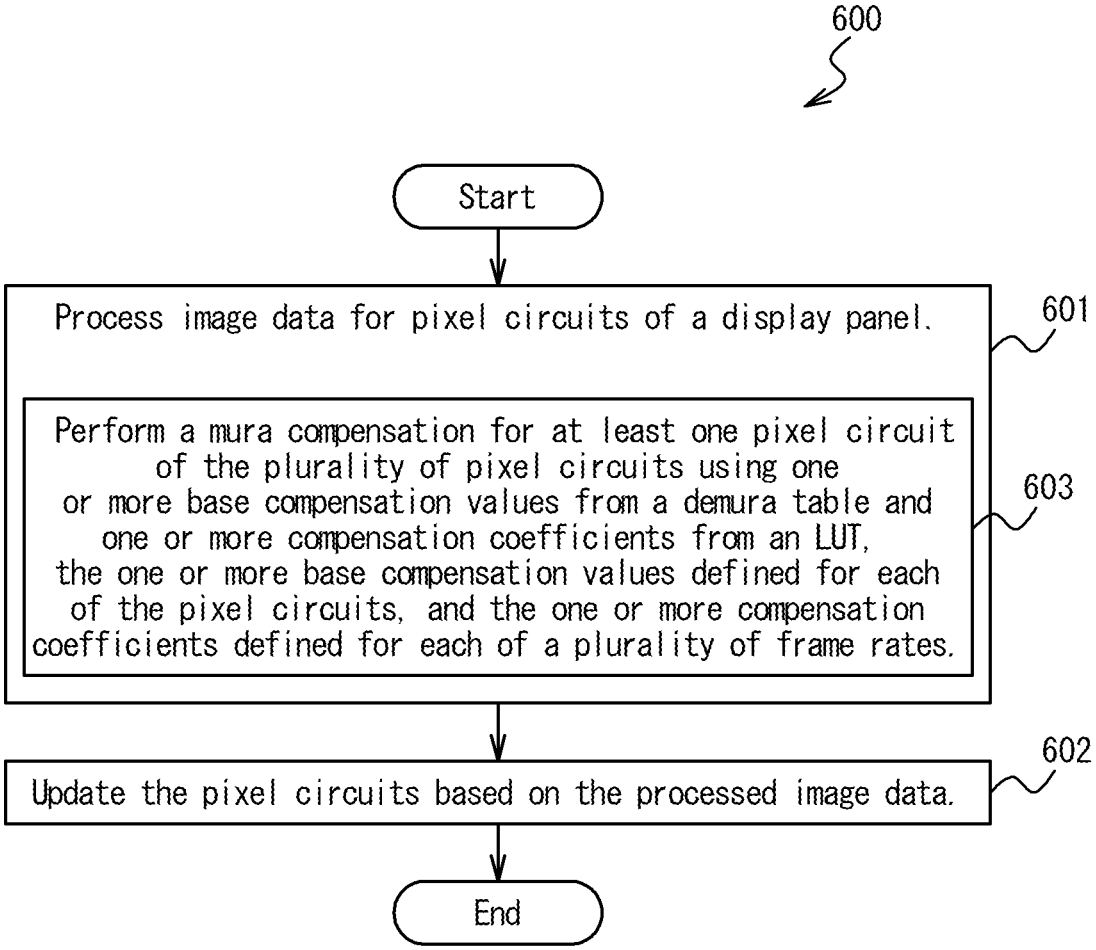
FIG. 6 illustrates example steps for driving a display panel, according to one or more embodiments.

Method 600 of FIG. 6 illustrates steps for driving a display panel (e.g., the display panel 10 illustrate in FIG. 1), according to one or more embodiments. At step 601, image data for pixel circuits of the display panel (e.g., the input image data D_in illustrated in FIGS. 1 and 3) are processed. This is followed by updating the pixel circuits based on the processed image data at step 602. Processing the image data for the pixel circuits include performing a mura compensation for at least one pixel circuit of the plurality of pixel circuits at step 603. In one implementation, the mura compensation uses one or more base compensation values from a demura table (e.g., the demura table 31) and one or more compensation coefficients from one or more LUTs (e.g. the LUTs 32), the one or more base compensation values defined for each of the pixel circuits, and the one or more compensation coefficients defined for each of a plurality of frame rates. This operation allows eliminating the need of preparing a demura table for each allowed frame rate by incorporating information concerning the frame rate dependency of the display mura in the LUT. The use of the LUT may provide mura compensation adapted to changes in the frame rate with reduced hardware.

For the embodiments illustrated in FIG. 3 and FIG. 5, the mura compensation for a pixel circuit 11 of interest may include acquiring one or more base compensation values for the pixel circuit 11 from the demura table 31 and acquiring one or more compensation coefficients for a specified frame rate from the LUTs 32. The acquisition of the one or more compensation coefficients may be based on the graylevel defined for the pixel circuit 11 of interest in the in the processed image data received from the image processing component 41. The one or more acquired compensation coefficients may be associated with the one or more base compensation values. The mura compensation may further includes determining a compensation amount for the pixel circuit 11 of interest based on the one or more base compensation values and the one or more associated compensation coefficients. In one implementation, the compensation amount may be determined as the sum of the products of the base compensation values and the associated compensation coefficients. The mura compensation may further includes modifying the gamma-transformed data D_gamma or the processed image data received from the image processing component 41 for the pixel circuit 11 of interest based on the compensation amount. The modification may include adding the compensation amount to the voltage value defined for the pixel circuit 11 of interest in the gamma-transformed data D_gamma. In an alternative embodiment, the modification may include adding the compensation amount to the graylevel defined for the pixel circuit 11 of interest in the processed image data received from the image processing component 41.

Referring back to FIG. 1, the demura table 31 and the one or more LUTs 32 may be generated and stored in the non-volatile memory 30 in a calibration process. The calibration process may be performed in a test of the display module 100 before shipping.

Figure 7:
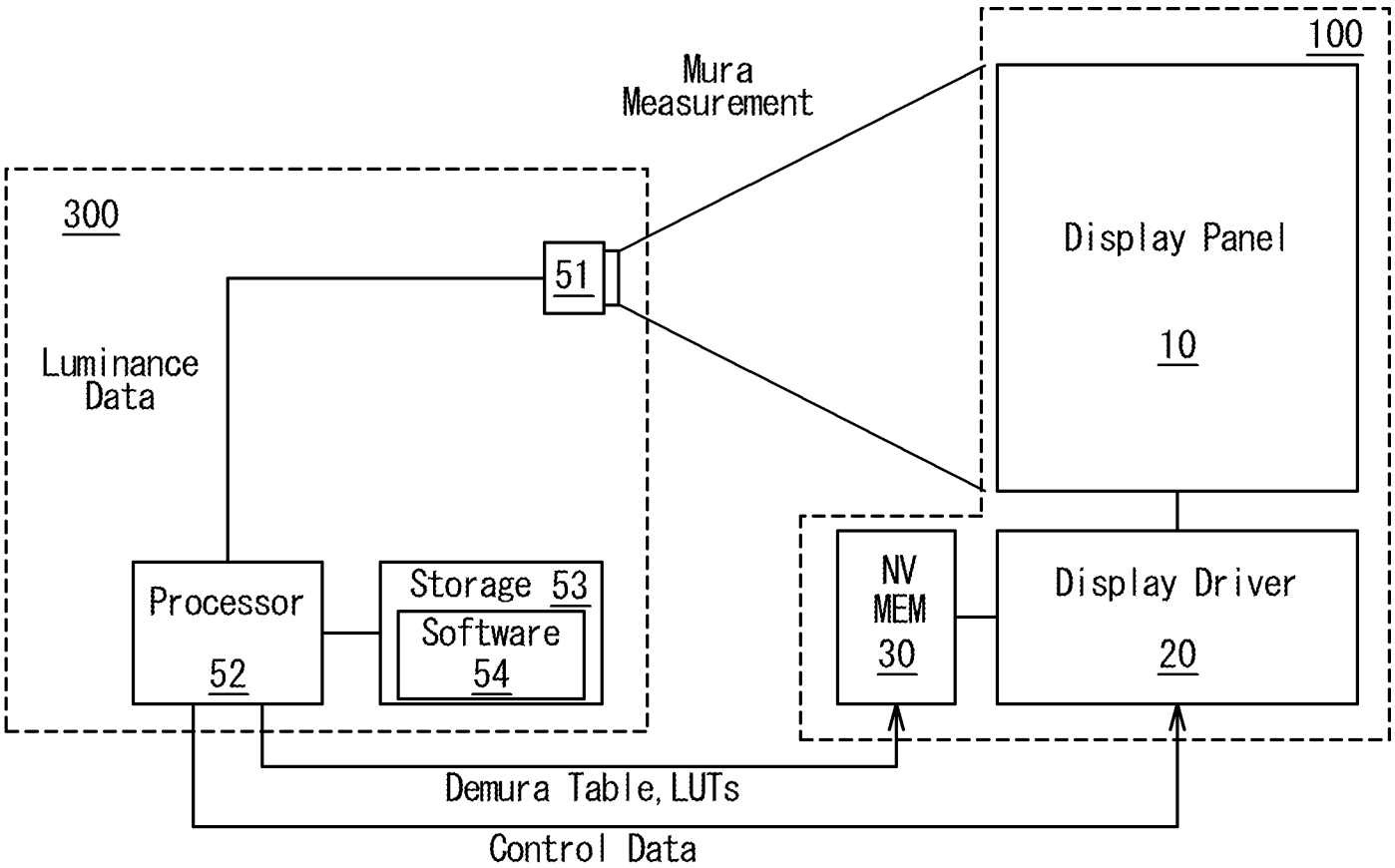
FIG. 7 illustrates an example configuration of a calibration device, according to one or more embodiments.

FIG. 7 illustrates an example configuration of a calibration device 300 configured to generate the demura table 31 and the LUTs 32, according to one or more embodiments. In the illustrated embodiment, the calibration device 300 includes an imaging device 51 (e.g., a camera), a processor 52, and a storage device 53. The imaging device 51 is used for mura measurement. The mura measurement may include acquiring luminance data indicative of luminances of the pixel circuits 11 for one or more test images. Each test image may be a plain image in which the same graylevel is specified for all the pixel circuits 11, and different graylevels may be specified for different test images. The luminance data are acquired for a plurality of predetermined graylevels and for a plurality of predetermined frame rates such that the correlations of the display mura with the graylevels and the frame rates can be extracted from the luminance data.

The processor 52 is configured to generate the demura table 31 and the one or more LUTs 32 based on the luminance data acquired by the imaging device 51. The demura table 31 is generated to include the base compensation values for the respective pixel circuits 11. The one or more LUTs 32 are generated to include compensation coefficients for the plurality of predetermined graylevels and the predetermined frame rates for which the luminance data are acquired. The processor 52 may be configured to generate the demura table 31 and the one or more LUTs 32 through a software process using a software program 54 stored in the storage device 53. In one implementation, the processor 52 is configured to execute the software program 54 to generate the demura table 31 and the one or more LUTs 32. The processor 52 is further configured to provide the demura table 31 and the one or more LUTs 32 to the display module 100. The processor 52 may be configured to write the demura table 31 and the one or more LUTs 32 into the non-volatile memory 30 of the display module 100. The processor 52 may be further configured to generate control data used to control the display module 100 during the calibration process. The control data may include test image data corresponding to the test images and instructions to display the test images.

Figure 8:
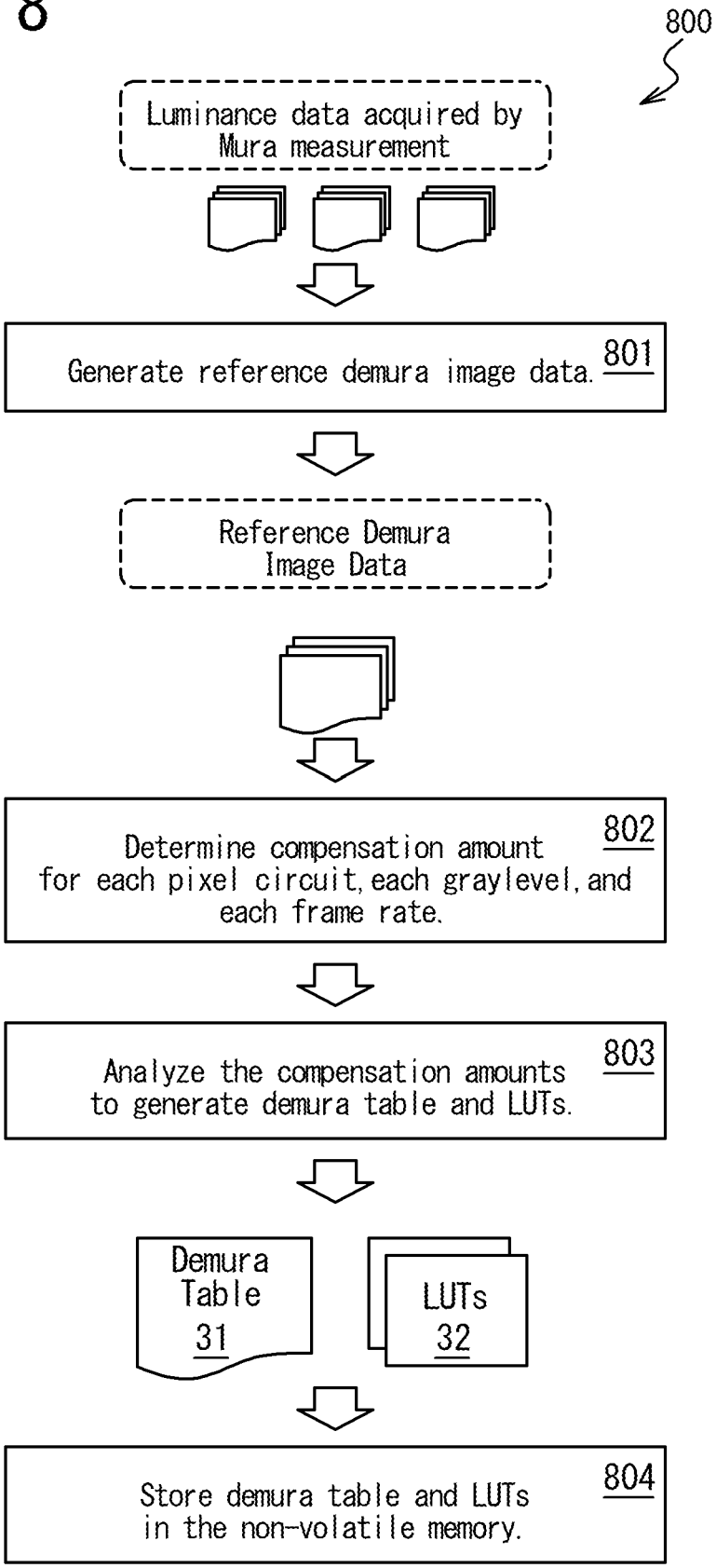
FIG. 8 illustrates an example process for generating a demura table and one or more LUTs, according to one or more embodiments.

FIG. 8 illustrates an example process 800 for generating the demura table 31 and the one or more LUTs 32, according to one or more embodiments. At step 801, the processor 52 generates reference demura image data based on the luminance data acquired by the imaging device 51 for the plurality of predetermined graylevels and the plurality of predetermined frame rates. In one implementation, the reference demura image data are generated such that a plain image, which is free from display mura, is displayed on the display panel 10 when the display panel 10 is driven based on the reference demura image data.

At step 802, the processor 52 determines a compensation amount of the mura compensation for each pixel circuit 11, each graylevel, and each frame rate based on the reference demura image data. The compensation amount may be determined as a value which is to be added to the voltage value of the gamma-transformed data D_gamma (e.g., for the embodiment illustrated in FIG. 3) or to the graylevel of the processed image data received from the image processing component 41 (e.g., for the embodiment illustrated in FIG. 5). FIG. 9 is a table that illustrates example compensation amounts determined for the respective pixel circuits 11, the respective predetermined graylevels, and the respective predetermined frame rates. The symbols "$p_1$" to "$p_N$" denote the pixel circuits 11 of the display panel 10.

Referring back to FIG. 8, at step 803, the processor 52 analyzes the compensation amounts to generate the demura table 31 and the LUTs 32. In one or more embodiments, the demura table 31 is generated such that the base compensation values described in the demura table 31 represent the variations in the compensation amounts among the pixel circuits 11, while the LUTs 32 are generated such that the compensation coefficients described in the LUTs 32 represent the dependencies of the compensation amounts on the graylevels and the frame rates. Using multiple LUTs 32 may allow precisely representing the dependencies of the compensation amounts on the graylevels and the frame rates. In one implementation, a first one of the LUTs 32 (e.g., LUT #1 illustrated in FIGS. 3 and 5) may represent primary-order dependencies of the compensation amounts on the graylevels and the frame rates, and a second one of the LUTs 32 (e.g., LUT #2 illustrated in FIGS. 3 and 5) may represent secondary-order dependencies of the compensation amounts on the graylevels and the frame rates.

At step 804, the processor 52 stores the demura table 31 and the LUTs 32 in the non-volatile memory 30. This completes the calibration process of the display module 100.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

image processing circuitry configured to process image data for a plurality of pixel circuits of a display panel, wherein the image processing circuitry comprises:

a demura table comprising one or more base compensation values associated with each of the plurality of pixel circuits, and a lookup table (LUT) comprising one or more compensation coefficients associated with each of a plurality of frame rates, wherein processing the image data for the pixel circuits comprises a mura compensation for at least one pixel circuit of the plurality of pixel circuits using the one or more base compensation values and the one or more compensation coefficients; and drive circuitry configured to update the plurality of pixel circuits based on the processed image data.

2. The display driver of claim 1, wherein the mura compensation for the at least one pixel circuit is based on one or more interpolated compensation coefficients, the one or more interpolated compensation coefficients acquired through interpolation of first one or more compensation coefficients defined in the LUT for a first selected frame rate of the plurality of frame rates and second one or more compensation coefficients defined in the LUT for a second selected frame rate of the plurality of frame rates.

3. The display driver of claim 2, the first selected frame rate and the second selected frame rate are determined such that a frame rate of a current frame period is between the first selected frame rate and the second selected frame rate.

4. The display driver of claim 1, wherein the one or more compensation coefficients defined in the LUT for each of the plurality of frame rates are used for the mura compensation for different ones of the plurality of pixel circuits.

5. The display driver of claim 1, wherein the one or more compensation coefficients defined for each of the plurality of frame rates comprises a plurality of compensation coefficients defined for a plurality of graylevels, respectively.

6. The display driver of claim 5, wherein the mura compensation for the at least one pixel circuit is based on:

one of the plurality of compensation coefficients defined for a first selected frame rate of the plurality of frame rates and a selected graylevel of the plurality of graylevels, the selected graylevel being determined based on the image data for the at least one pixel circuit.

7. The display driver of claim 1, wherein processing the image data for the at least one pixel circuit further comprises generating gamma-transformed data for the at least one pixel circuit by applying a gamma transformation to the image data for the at least one pixel circuit, wherein performing the mura compensation comprises generating output voltage data for the at least one pixel circuit by modifying the gamma-transformed data for the at least one pixel circuit based on the one or more base compensation values and the one or more compensation coefficients.

8. The display driver of claim 7, wherein modifying the gamma-transformed data comprises adding a compensation amount to a voltage value of the gamma-transformed data for the at least one pixel circuit, the compensation amount being determined based on the one or more base compensation values defined for the at least one pixel circuit and the one or more compensation coefficients defined for a first selected frame rate of the plurality of frame rates.

9. The display driver of claim 1, wherein performing the mura compensation comprises generating mura-compensated image data for the at least one pixel circuit based on the one or more base compensation values for the at least one pixel circuit and the one or more compensation coefficients defined for a first selected frame rate of the plurality of frame rates, wherein processing the image data for the at least one pixel circuit further comprises applying a gamma transformation to the mura-compensated image data for the at least one pixel circuit to generate output voltage data for the at least one pixel circuit.

10. The display driver of claim 1, wherein the image processing circuitry further comprises one or more additional LUTs each comprising second one or more compensation coefficients defined for each of the plurality of frame rates, wherein the mura compensation for the at least one pixel circuit is further based on the second one or more compensation coefficients.

11. The display driver of claim 1, further comprising a demura random access memory (RAM) configured to store the demura table and the LUT.

12. The display driver of claim 11, wherein the demura RAM is configured to receive the demura table and the LUT from a non-volatile memory external to the display driver.

13. A calibration device, comprising:

an imaging device configured to acquire luminances of pixel circuits of a display panel for a plurality of frame rates;

a processor configured to:

generate, based on the luminances of pixel circuits for the plurality of frame rates, a demura table comprising one or more base compensation values defined for each of the pixel circuits and a LUT comprising first one or more compensation coefficients defined for each of the plurality of frame rates; and provide the demura table and the LUT to a display module comprising the display panel.

14. The calibration device of claim 13, wherein the processor is configured to determine, based on the luminances of the pixel circuits for the plurality of frame rates, compensation amounts of mura compensations for the pixel circuits and the plurality of frame rates;

wherein the demura table is generated based on information of variations in the luminances of the pixel circuits depending on the pixel circuits; and wherein the LUT is generated based on information of variations in the luminances of the pixel circuits depending on the plurality of frame rates.

15. The calibration device of claim 14, wherein determining the compensation amounts comprises:

generating, based on the luminances of pixel circuits for the plurality of frame rates, demura image data including graylevels of the pixel circuits, the graylevels being determined to display an image with even luminance on the display panel.

16. A method, comprising:

processing image data for a plurality of pixel circuits of a display panel; and updating the plurality of pixel circuits based on the processed image data, wherein processing the image data for the pixel circuits comprises a mura compensation for at least one pixel circuit of the plurality of pixel circuits using one or more base compensation values from a demura table and one or more compensation coefficients from an LUT, the one or more base compensation values defined for each of the pixel circuits, and the one or more compensation coefficients defined for each of a plurality of frame rates.

17. The method of claim 16, wherein the mura compensation for the at least one pixel circuit is based on one or more interpolated compensation coefficients acquired through interpolation of first one or more compensation coefficients defined for a first selected frame rate of the plurality of frame rates and second one or more compensation coefficients defined in the LUT for a second selected frame rate of the plurality of frame rates.

18. The method of claim 16, wherein the one or more compensation coefficients defined in the LUT for each of the plurality of frame rates are used for the mura compensation for different ones of the plurality of pixel circuits.

19. The method of claim 16, wherein the one or more compensation coefficients defined for each of the plurality of frame rates comprises a plurality of compensation coefficients defined for a plurality of graylevels, respectively.

20. The method of claim 16, wherein processing the image data for the at least one pixel circuit further comprises generating gamma-transformed data for the at least one pixel circuit by applying a gamma transformation to the image data for the at least one pixel circuit, wherein performing the mura compensation comprises generating output voltage data for the at least one pixel circuit by modifying the gamma-transformed data for the at least one pixel circuit based on the one or more base compensation values and the one or more compensation coefficients.

* * * * *